US010714041B2

(12) United States Patent
Shi

(10) Patent No.: US 10,714,041 B2
(45) Date of Patent: Jul. 14, 2020

(54) GATE DRIVER ON ARRAY CIRCUIT

(71) Applicant: Shenzhen China Star Optoelectronics Semiconductor Display Technology Co., Ltd., Shenzhen (CN)

(72) Inventor: Longqiang Shi, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 250 days.

(21) Appl. No.: 15/743,901

(22) PCT Filed: Dec. 5, 2017

(86) PCT No.: PCT/CN2017/114622

§ 371 (c)(1),
(2) Date: Jan. 11, 2018

(87) PCT Pub. No.: WO2019/090875

PCT Pub. Date: May 16, 2019

(65) Prior Publication Data

US 2020/0082776 A1 Mar. 12, 2020

(30) Foreign Application Priority Data

Nov. 7, 2017 (CN) ..... 2017 1 1086188

(51) Int. Cl.
*G09G 3/36* (2006.01)

(52) U.S. Cl.
CPC ..... *G09G 3/3677* (2013.01); *G09G 3/3696* (2013.01); *G09G 2310/08* (2013.01)

(58) Field of Classification Search
CPC ..... G09G 3/3266; G09G 3/3674; G09G 2300/043; G09G 2310/0267; G09G 2310/0278; G09G 2310/0283; G09G 2310/0286; G09G 2310/0202; G09G 2310/0213; G09G 2310/0216; G09G 2320/0219
See application file for complete search history.

(56) References Cited

U.S. PATENT DOCUMENTS 9,324,288 B1 * 4/2016 Dai ..... G09G 3/3648
10,127,878 B1 * 11/2018 Lv ..... G11C 19/28
2010/0260312 A1 * 10/2010 Tsai ..... G09G 3/3677 377/79
2012/0320021 A1 * 12/2012 Chang ..... G09G 3/3655 345/211
2014/0103983 A1 * 4/2014 Chang ..... G09G 3/3655 327/198

(Continued)

*Primary Examiner* — Dong Hui Liang
(74) *Attorney, Agent, or Firm* — Hemisphere Law, PLLC; Zhigang Ma

(57) ABSTRACT

A GOA circuit uses the high voltage level of a high-frequency clock signal for pulling up the voltage level of a second node during the period of outputting a scan signal, to make the voltage level of the second node be larger than the voltage level of a stage transmitting signal of the (n−4)th stage of GOA unit, thereby to keep the pull-up controlling module in off state during the period of outputting the scan signal, for promoting the stability of the GOA circuit and preventing the GOA circuit from malfunction.

15 Claims, 2 Drawing Sheets

(56) References Cited

U.S. PATENT DOCUMENTS

| | | | | |
|---|---|---|---|---|
| 2015/0187302 | A1* | 7/2015 | Dai | G09G 3/3677 345/92 |
| 2015/0187312 | A1* | 7/2015 | Dai | G09G 3/3648 345/213 |
| 2015/0294636 | A1* | 10/2015 | Yu | G09G 3/3655 345/204 |
| 2016/0005372 | A1* | 1/2016 | Yu | G09G 3/3677 345/208 |
| 2016/0125824 | A1* | 5/2016 | Dai | G09G 3/3648 345/213 |
| 2016/0267832 | A1* | 9/2016 | Dai | G09G 3/2092 |
| 2016/0284293 | A1* | 9/2016 | Dai | G09G 3/36 |
| 2016/0284294 | A1* | 9/2016 | Dai | G09G 3/3648 |
| 2016/0284295 | A1* | 9/2016 | Dai | G09G 3/3648 |
| 2016/0284296 | A1* | 9/2016 | Dai | G09G 3/36 |
| 2017/0270886 | A1* | 9/2017 | Yu | G09G 3/3677 |
| 2018/0122318 | A1* | 5/2018 | Cao | G09G 3/3677 |
| 2018/0182337 | A1* | 6/2018 | Lv | G09G 3/3677 |
| 2018/0190228 | A1* | 7/2018 | Xu | G09G 3/3677 |
| 2018/0268768 | A1* | 9/2018 | Lv | H01L 27/124 |
| 2019/0103167 | A1* | 4/2019 | Zeng | G09G 3/3677 |

* cited by examiner

GATE DRIVER ON ARRAY CIRCUIT

RELATED APPLICATIONS

The present application is a National Phase of International Application Number PCT/CN2017/114622, filed on Dec. 5, 2017, and claims the priority of China Application 201711086188.6, filed on Nov. 7, 2017.

FIELD OF THE DISCLOSURE

The disclosure relates to a display technical field, and more particularly to a gate driver on array (GOA) circuit.

BACKGROUND

The Liquid Crystal Display (LCD) with advantages of thin body, power saving and no radiation has been widely used in many applications, such as LCD TV, mobile phone, personal digital assistant (PDA), digital camera, notebook, laptop, etc., and dominates the flat panel display field.

The active matrix liquid crystal display (AMLCD) is the most popular display device currently. The AMLCD comprises a plurality of pixels, and each pixel connects a thin film transistor (TFT). The gate of the TFT is connected to the scan line extending along the horizontal direction. The source of the TFT is connected to the data line extending along the vertical direction. The drain of the TFT is connected to the corresponding pixel electrode. A sufficient positive voltage is applied to a scan line to switch on all the TFTs connected to the scan line, thereby to write the data signal of the data line into the pixel electrodes and to control the transmittances of different liquid crystals for achieving the effect of controlling colors and brightness.

The gate driver on array (GOA) technology utilizes the current process of fabricating array on the thin film transistor liquid crystal display panel to manufacture the driving circuit of gate lines on the TFT array substrate, for realizing the driving method of scanning the gate lines row by row. The GOA technology can reduce the bonding procedures for connecting the external integrated circuit (IC) and has potential to raise the productivity and reduce the cost. Meanwhile, it can make the liquid crystal display panel more suitable to the narrow frame or non-frame design of display products.

The metal oxide semiconductors, such as indium gallium zinc oxide (IGZO), have higher carrier mobility and good stability for devices. Therefore, using the metal oxide semiconductor thin film transistors for fabricating the GOA circuits can reduce the complexity, decrease the scales and numbers of the thin film transistors and the number of power supply for stabilizing the performances of the thin film transistors, thereby to simplify the structures of GOA circuits, achieve the display panel with narrow frame and reduce power consumption at the same time.

However, during the work process of GOA circuits, the threshold voltages of thin film transistors become the negative values frequently, thereby to lead to the malfunction of the GOA circuits. Especially, for the GOA circuits fabricated by applying the metal oxide semiconductor thin film transistors, the above issue is more serious.

SUMMARY

A purpose of the present invention is to provide a gate driver on array (GOA) circuit for promoting the stability thereof to prevent the GOA circuit from malfunction For achieving the above purpose, the present invention provides a GOA circuit comprising multiple stages of GOA units connected in cascade, wherein each stage of GOA unit comprises a pull-up controlling module, a pull-up module, a transmission module, a pull-down module, a bootstrap module and a pull-down holding module.

in a nth stage of GOA unit, n is an integer, and the pull-up module is connected electrically to a first node of a (n+4)th stage of GOA unit and receiving a stage transmitting signal and a high-frequency clock signal from a (n−4)th stage of GOA unit, for pulling up a voltage level of the first node according to the stage transmitting signal of a (n−4)th stage of GOA unit, and pulling down a voltage level of a second node by using the high-frequency clock signal under control of the first node of the (n+4)th stage of GOA unit.

The pull-up module is connected electrically to the first node and receiving the high-frequency clock signal, for outputting a scan signal by using the high-frequency clock signal under the control of the first node.

The transmission module is connected electrically to the first node and receiving the high-frequency clock signal, for outputting the stage transmitting signal by using the high-frequency clock signal under the control of the first node.

The pull-down module is connected electrically to the second node and receiving the scan signal of the (n+4)th stage of GOA unit, for pulling down the voltage level of the first node by using the voltage level of the second node, under control of the scan signal of the (n+4)th stage of GOA unit or a second start signal.

The bootstrap module is connected electrically to the first node and the scan signal, for pulling up and then holding the voltage level of the first node, during a period of outputting the scan signal.

The pull-down holding module is connected electrically to the first node, a third node, a fourth node, a first DC low potential and a second DC low potential, and receiving a first low-frequency clock signal, a second low-frequency clock signal, the scan signal and the stage transmitting signal, for pulling down voltage levels of the third node and the fourth node to the second DC low potential when the voltage level of the first node is pulled up, and for pulling up the voltage levels of the third node and the fourth node by using the first low-frequency clock signal and the second low-frequency clock signal alternatively, after the voltage level of the first node is pulled down, to maintain the voltage levels of the first node, the stage transmitting signal and the scan signal at the first DC low potential.

The pull-up controlling module comprises a first thin film transistor, a second thin film transistor and a third thin film transistor.

The first thin film transistor includes a gate and a source both receiving the stage transmitting signal of the (n−4)th stage of GOA unit, and a drain connected electrically to the second node.

The second thin film transistor includes a gate receiving the stage transmitting signal of the (n−4)th stage of GOA unit, a source connected electrically to the second node, and a drain connected electrically to the first node.

The third thin film transistor includes a gate connected electrically to the first node of the (n+4)th stage of GOA unit, a source connected electrically to the second node, and a drain receiving the high-frequency clock signal.

The pull-up module comprises a fourth thin film transistor, wherein the fourth thin film transistor includes a gate connected electrically to the first node, a source receiving the high-frequency clock signal, and a drain outputting the scan signal.

The transmission module comprises a fifth thin film transistor, wherein the fifth thin film transistor includes a gate connected electrically to the first node, a source receiving the high-frequency clock signal, and a drain outputting the stage transmitting signal.

The pull-down module comprises a sixth thin film transistor, wherein the sixth thin film transistor includes a gate receiving the scan signal of the (n+4)th stage of GOA unit, a source connected to the second node, and a drain connected to the first node.

The bootstrap module comprises a bootstrap capacitor, wherein the bootstrap capacitor includes a first terminal connected to the first node and a second terminal receiving the scan signal.

The pull-down holding module comprises a first pull-down holding circuit and a second pull-down holding circuit.

The first pull-down holding circuit is connected electrically to the first node, the third node, the first DC low potential and the second DC low potential, and is receiving the first low-frequency clock signal, the scan signal and the stage transmitting signal, for pulling down the voltage level of the third node to the second DC low potential when the voltage level of the first node is pulled up, and for pulling up the voltage level of the third node periodically by using the first low-frequency clock signal, after the voltage level of the first node is pulled down, to maintain the voltage levels of the first node, the stage transmitting signal and the scan signal at the first DC low potential.

The second pull-down holding circuit is connected electrically to the first node, the fourth node, the first DC low potential and the second DC low potential, and is receiving the second low-frequency clock signal, the scan signal and the stage transmitting signal, for pulling down the voltage level of the fourth node to the second DC low potential when the voltage level of the first node is pulled up, and for pulling up the voltage level of the fourth node periodically by using the second low-frequency clock signal, after the voltage level of the first node is pulled down, to maintain the voltage levels of the first node, the stage transmitting signal and the scan signal at the first DC low potential.

The first pull-down holding circuit comprises a seventh thin film transistor, an eighth thin film transistor, a ninth thin film transistor, a tenth thin film transistor, a eleventh thin film transistor, a twelfth thin film transistor and a thirteen thin film transistor.

The seventh thin film transistor includes a gate connected electrically to the third node, a drain receiving the scan signal, and a source receiving the first DC low potential.

The eighth thin film transistor includes a gate connected electrically to the third node, a drain receiving the stage transmitting signal, and a source receiving the first DC low potential.

The ninth thin film transistor includes a gate connected electrically to the third node, a drain connected electrically to the first node, and a source receiving the first DC low potential.

The tenth thin film transistor includes a gate and a source both receiving a first low-frequency clock signal, and a drain connected electrically to a gate of the eleventh thin film transistor.

The eleventh thin film transistor includes a source receiving the first low-frequency clock signal, and a drain connected electrically to the third node.

The twelfth thin film transistor includes a gate connected electrically to the first node, a source connected electrically to the gate of the eleventh thin film transistor, and a drain receiving the second DC low potential.

The thirteenth thin film transistor includes a gate connected electrically to the first node, a source connected electrically to the third node, and a drain receiving the second DC low potential.

The second pull-down holding circuit comprises a fourteenth thin film transistor, a fifteenth thin film transistor, a sixteenth thin film transistor, a seventeenth thin film transistor, an eighteenth thin film transistor, a nineteenth thin film transistor and a twentieth thin film transistor.

The fourteenth thin film transistor includes a gate connected electrically to the fourth node, a drain connected electrically to the first node, and a source receiving the first DC low potential.

The fifteenth thin film transistor includes a gate connected electrically to the fourth node, a drain receiving the stage transmitting signal, and a source receiving the first DC low potential.

The sixteenth thin film transistor includes a gate connected electrically to the fourth node, a drain receiving the scan signal, and a source receiving the first DC low potential.

The seventeenth thin film transistor includes a gate and a source both receiving a second low-frequency clock signal, and a drain connected electrically to a gate of the eighteenth thin film transistor.

The eighteenth thin film transistor includes a source receiving the second low-frequency clock signal and a drain connected electrically to the fourth node.

The nineteenth thin film transistor includes a gate connected electrically to the first node, a source connected electrically to the gate of the eighteenth thin film transistor, and a drain receiving the second DC low potential.

The twentieth thin film transistor includes a gate connected electrically to the first node, a source connected electrically to the fourth node, a drain receiving the second DC low potential.

The high-frequency clock signal received by the nth stage of GOA unit is one of a first high-frequency clock signal, a second high-frequency clock signal, a third high-frequency clock signal, a fourth high-frequency clock signal, a fifth high-frequency clock signal, a sixth high-frequency clock signal, a seventh high-frequency clock signal and an eighth high-frequency clock signal, and a phase of the high-frequency clock signal received by the nth stage of GOA unit is opposite to a phase of the high-frequency clock signal received by the (n+4)th stage of GOA unit.

The first DC low potential is larger than the second DC low potential; a phase of the first low-frequency clock signal is opposite to a phase of the second low-frequency clock signal.

The present invention also provides a GOA circuit, comprises; multiple stages of GOA units connected in cascade, wherein each stage of GOA unit comprises a pull-up controlling module, a pull-up module, a transmission module, a pull-down module, a bootstrap module and a pull-down holding module.

In a nth stage of GOA unit, n is an integer, and the pull-up module is connected electrically to a first node of a (n+4)th stage of GOA unit and receiving a stage transmitting signal and a high-frequency clock signal from a (n−4)th stage of GOA unit, for pulling up a voltage level of the first node according to the stage transmitting signal of a (n−4)th stage of GOA unit, and pulling down a voltage level of a second node by using the high-frequency clock signal under control of the first node of the (n+4)th stage of GOA unit.

The pull-up module is connected electrically to the first node and receiving the high-frequency clock signal, for outputting a scan signal by using the high-frequency clock signal under the control of the first node.

The transmission module is connected electrically to the first node and receiving the high-frequency clock signal, for outputting the stage transmitting signal by using the high-frequency clock signal under the control of the first node.

The pull-down module is connected electrically to the second node and receiving the scan signal of the (n+4)th stage of GOA unit, for pulling down the voltage level of the first node by using the voltage level of the second node, under control of the scan signal of the (n+4)th stage of GOA unit or a second start signal.

The bootstrap module is connected electrically to the first node and the scan signal, for pulling up and then holding the voltage level of the first node, during a period of outputting the scan signal.

The pull-down holding module is connected electrically to the first node, a third node, a fourth node, a first DC low potential and a second DC low potential, and receiving a first low-frequency clock signal, a second low-frequency clock signal, the scan signal and the stage transmitting signal, for pulling down voltage levels of the third node and the fourth node to the second DC low potential when the voltage level of the first node is pulled up, and for pulling up the voltage levels of the third node and the fourth node by using the first low-frequency clock signal and the second low-frequency clock signal alternatively, after the voltage level of the first node is pulled down, to maintain the voltage levels of the first node, the stage transmitting signal and the scan signal at the first DC low potential.

The pull-up controlling module comprises a first thin film transistor, a second thin film transistor and a third thin film transistor.

The first thin film transistor includes a gate and a source both receiving the stage transmitting signal of the (n−4)th stage of GOA unit, and a drain connected electrically to the second node.

The second thin film transistor includes a gate receiving the stage transmitting signal of the (n−4)th stage of GOA unit, a source connected electrically to the second node, and a drain connected electrically to the first node.

The third thin film transistor includes a gate connected electrically to the first node of the (n+4)th stage of GOA unit, a source connected electrically to the second node, and a drain receiving the high-frequency clock signal.

The pull-up module comprises: a fourth thin film transistor, wherein the fourth thin film transistor includes a gate connected electrically to the first node, a source receiving the high-frequency clock signal, and a drain outputting the scan signal.

The transmission module comprises: a fifth thin film transistor, wherein the fifth thin film transistor includes a gate connected electrically to the first node, a source receiving the high-frequency clock signal, and a drain outputting the stage transmitting signal.

The pull-down module comprises: a sixth thin film transistor, wherein the sixth thin film transistor includes a gate receiving the scan signal of the (n+4)th stage of GOA unit, a source connected to the second node, and a drain connected to the first node.

The bootstrap module comprises: a bootstrap capacitor, wherein the bootstrap capacitor includes a first terminal connected to the first node and a second terminal receiving the scan signal.

The present invention has following advantages. The present invention provides a GOA circuit. The nth stage of GOA unit in the GOA circuit uses the high voltage level of the high-frequency clock signal for pulling up the voltage level of the second node during the period of outputting the scan signal, to make the voltage level of the second node be larger than the voltage level of the stage transmitting signal of the (n−4)th stage of GOA unit, thereby to keep the pull-up controlling module in off state during the period of outputting the scan signal, for promoting the stability of the GOA circuit and preventing the GOA circuit from malfunction.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

The specific structural and functional details disclosed herein are only representative and are intended for describing exemplary embodiments of the disclosure. However, the disclosure can be embodied in many forms of substitution, and should not be interpreted as merely limited to the embodiments described herein.

Figure 1:
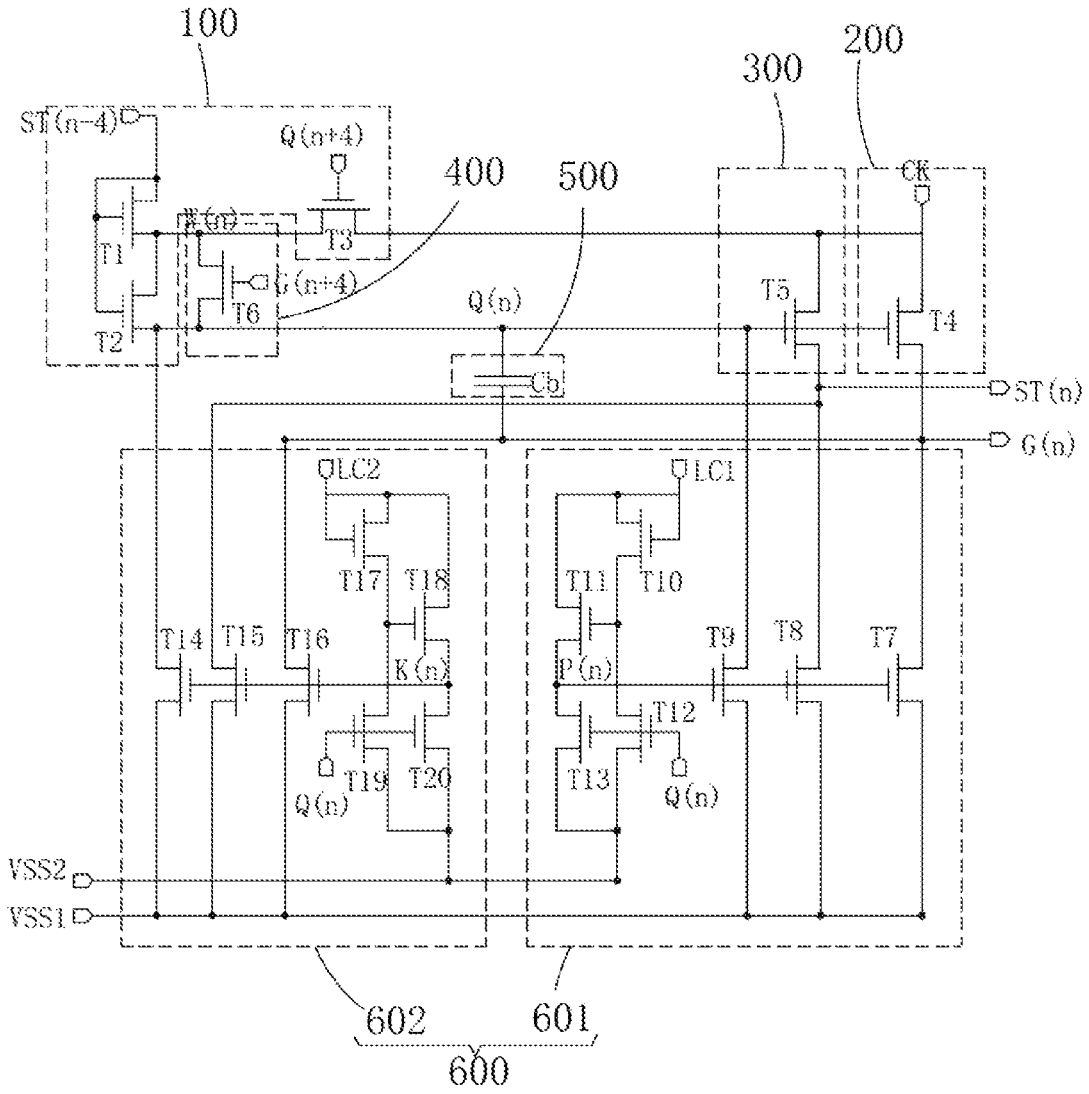
FIG. 1 is a circuit diagram illustrating the GOA circuit of the present invention.

Referring to FIG. 1, the present invention provides a gate driver on array (GOA) circuit. The GOA circuit comprises multiple stages of GOA units connected in cascade. Each stage of GOA unit comprises a pull-up controlling module 100, a pull-up module 200, a transmission module 300, a pull-down module 400, a bootstrap module 500 and a pull-down holding module 600.

In a nth stage of GOA unit, n is an integer, and the pull-up module 100 is connected electrically to a first node Q(n+4) of a (n+4)th stage of GOA unit and receiving a stage transmitting signal ST(n−4) and a high-frequency clock signal CK from a (n−4)th stage of GOA unit, for pulling up a voltage level of the first node Q(n) according to the stage transmitting signal ST(n−4) of a (n−4)th stage of GOA unit or a first start signal STV1, and pulling down a voltage level of a second node W(n) by using the high-frequency clock signal CK under control of the first node Q(n+4) of the (n+4)th stage of GOA unit or a second start signal STV2.

The pull-up module 200 is connected electrically to the first node Q(n) and receiving the high-frequency clock signal CK, for outputting a scan signal G(n) by using the high-frequency clock signal CK under the control of the first node Q(n).

The transmission module 300 is connected electrically to the first node Q(n) and is receiving the high-frequency clock signal CK, for outputting the stage transmitting signal ST(n) by using the high-frequency clock signal CK under the control of the first node Q(n).

The pull-down module 400 is connected electrically to the second node W(n) and receiving the scan signal G(n+4) of the (n+4)th stage of GOA unit, for pulling down the voltage level of the first node Q(n) by using the voltage level of the second node W(n), under the control of the scan signal G(n+4) of the (n+4)th stage of GOA unit or the second start signal STV2.

The bootstrap module 500 is connected electrically to the first node Q(n) and the scan signal G(n), for pulling up and then holding the voltage level of the first node Q(n), during a period of outputting the scan signal G(n).

The pull-down holding module 600 is connected electrically to the first node Q(n), a third node P(n), a fourth node K(n), a first DC low potential Vss1 and a second DC low potential Vss2, and is receiving a first low-frequency clock signal LC1, a second low-frequency clock signal LC2, the scan signal G(n) and the stage transmitting signal ST(n), for pulling down voltage levels of the third node P(n) and the fourth node K(n) to the second DC low potential Vss2 when the voltage level of the first node Q(n) is pulled up, and for pulling up the voltage levels of the third node P(n) and the fourth node K(n) by using the first low-frequency clock signal LC1 and the second low-frequency clock signal LC2 alternatively, after the voltage level of the first node Q(n) is pulled down, to maintain the voltage levels of the first node Q(n), the stage transmitting signal ST(n) and the scan signal G(n) at the first DC low potential Vss1.

In specific, the pull-down holding module 600 comprises a first pull-down holding circuit 601 and a second pull-down holding circuit 602. The first pull-down holding circuit 601 is connected electrically to the first node Q(n), the third node P(n), the first DC low potential Vss1 and the second DC low potential Vss2, and is receiving the first low-frequency clock signal LC1, the scan signal G(n) and the stage transmitting signal ST(n), for pulling down the voltage level of the third node P(n) to the second DC low potential Vss2 when the voltage level of the first node Q(n) is pulled up, and for pulling up the voltage level of the third node P(n) periodically by using the first low-frequency clock signal LC1, after the voltage level of the first node Q(n) is pulled down, to maintain the voltage levels of the first node Q(n), the stage transmitting signal ST(n) and the scan signal G(n) at the first DC low potential Vss1.

The second pull-down holding circuit 602 is connected electrically to the first node Q(n), the fourth node K(n), the first DC low potential Vss1 and the second DC low potential Vss2, and is receiving the second low-frequency clock signal LC2, the scan signal G(n) and the stage transmitting signal ST(n), for pulling down the voltage level of the fourth node K(n) to the second DC low potential Vss2 when the voltage level of the first node Q(n) is pulled up, and for pulling up the voltage level of the fourth node K(n) periodically by using the second low-frequency clock signal LC2, after the voltage level of the first node Q(n) is pulled down, to maintain the voltage levels of the first node Q(n), the stage transmitting signal ST(n) and the scan signal G(n) at the first DC low potential Vss1.

In specific, as shown in FIG. 1, in one preferred embodiment of the present invention, the pull-up controlling module 100 comprises a first thin film transistor T1, a second thin film transistor T2 and a third thin film transistor T3.

The first thin film transistor T1 includes a gate and a source both receiving the stage transmitting signal ST(n−4) of the (n−4)th stage of GOA unit, and a drain connected electrically to the second node W(n).

The second thin film transistor T2 includes a gate receiving the stage transmitting signal ST(n−4) of the (n−4)th stage of GOA unit, a source connected electrically to the second node W(n), and a drain connected electrically to the first node Q(n).

The third thin film transistor T3 includes a gate connected electrically to the first node Q(n+4) of the (n+4)th stage of GOA unit, a source connected electrically to the second node W(n), and a drain receiving the high-frequency clock signal CK.

The pull-up module 200 comprises a fourth thin film transistor T4. The fourth thin film transistor T4 includes a gate connected electrically to the first node Q(n), a source receiving the high-frequency clock signal CK, and a drain outputting the scan signal G(n).

The transmission module 300 comprises a fifth thin film transistor T5. The fifth thin film transistor T5 includes a gate connected electrically to the first node Q(n), a source receiving the high-frequency clock signal OK, and a drain outputting the stage transmitting signal ST(n).

The pull-down module 400 comprises a sixth thin film transistor T6. The sixth thin film transistor T6 includes a gate receiving the scan signal G(n+4) of the (n+4)th stage of GOA unit, a source connected electrically to the second node W(n), and a drain connected electrically to the first node Q(n).

The bootstrap module 500 comprises a bootstrap capacitor Cb. The bootstrap capacitor Cb includes a first terminal connected to the first node Q(n) and a second terminal receiving the scan signal G(n).

The first pull-down holding circuit 601 comprises a seventh thin film transistor T7, an eighth thin film transistor T8, a ninth thin film transistor T9, a tenth thin film transistor T10, an eleventh thin film transistor T11, a twelfth thin film transistor T12 and a thirteen thin film transistor T13.

The seventh thin film transistor T7 includes a gate connected electrically to the third node P(n), a drain receiving the scan signal G(n), and a source receiving the first DC low potential Vss1.

The eighth thin film transistor T8 includes a gate connected electrically to the third node P(n), a drain receiving the stage transmitting signal ST(n), and a source receiving the first DC low potential Vss1.

The ninth thin film transistor T9 includes a gate connected electrically to the third node P(n), a drain connected electrically to the first node Q(n), and a source receiving the first DC low potential Vss1.

The tenth thin film transistor T10 includes a gate and a source both receiving a first low-frequency clock signal LC1, and a drain connected electrically to a gate of the eleventh thin film transistor T11.

The eleventh thin film transistor T11 includes a source receiving the first low-frequency clock signal LC1, and a drain connected electrically to the third node P(n).

The twelfth thin film transistor T12 includes a gate connected electrically to the first node Q(n), a source connected electrically to the gate of the eleventh thin film transistor T11, and a drain receiving the second DC low potential Vss2.

The thirteenth thin film transistor T13 includes a gate connected electrically to the first node Q(n), a source connected electrically to the third node P(n), and a drain receiving the second DC low potential Vss2.

The second pull-down holding circuit 602 comprises a fourteenth thin film transistor T14, a fifteenth thin film transistor T15, a sixteenth thin film transistor T16, a seventeenth thin film transistor T17, an eighteenth thin film transistor T18, a nineteenth thin film transistor T19 and a twentieth thin film transistor T20.

The fourteenth thin film transistor T14 includes a gate connected electrically to the fourth node K(n), a drain connected electrically to the first node Q(n), and a source receiving the first DC low potential Vss1.

The fifteenth thin film transistor T15 includes a gate connected electrically to the fourth node K(n), a drain receiving the stage transmitting signal ST(n), and a source receiving the first DC low potential Vss1.

The sixteenth thin film transistor T16 includes a gate connected electrically to the fourth node K(n), a drain receiving the scan signal G(n), and a source receiving the first DC low potential Vss1.

The seventeenth thin film transistor T17 includes a gate and a source both receiving a second low-frequency clock signal LC2, and a drain connected electrically to a gate of the eighteenth thin film transistor T18.

The eighteenth thin film transistor T18 includes a source receiving the second low-frequency clock signal LC2 and a drain connected electrically to the fourth node K(n).

The nineteenth thin film transistor T19 includes a gate connected electrically to the first node Q(n), a source connected electrically to the gate of the eighteenth thin film transistor T18, and a drain receiving the second DC low potential Vss2.

The twentieth thin film transistor T20 includes a gate connected electrically to the first node Q(n), a source connected electrically to the fourth node K(n), a drain receiving the second DC low potential Vss2.

Preferably, all the thin film transistors applied in the GOA circuits of the present invention are metal oxide semiconductor thin film transistors, such as IGZO thin film transistors. The GOA circuit provided by the present invention can overcome effectively the electric leakage issue of the IGZO thin film transistors and make sure the GOA circuit working normally, thereby to fully take the advantages of the IGZO thin film transistors.

Figure 2:
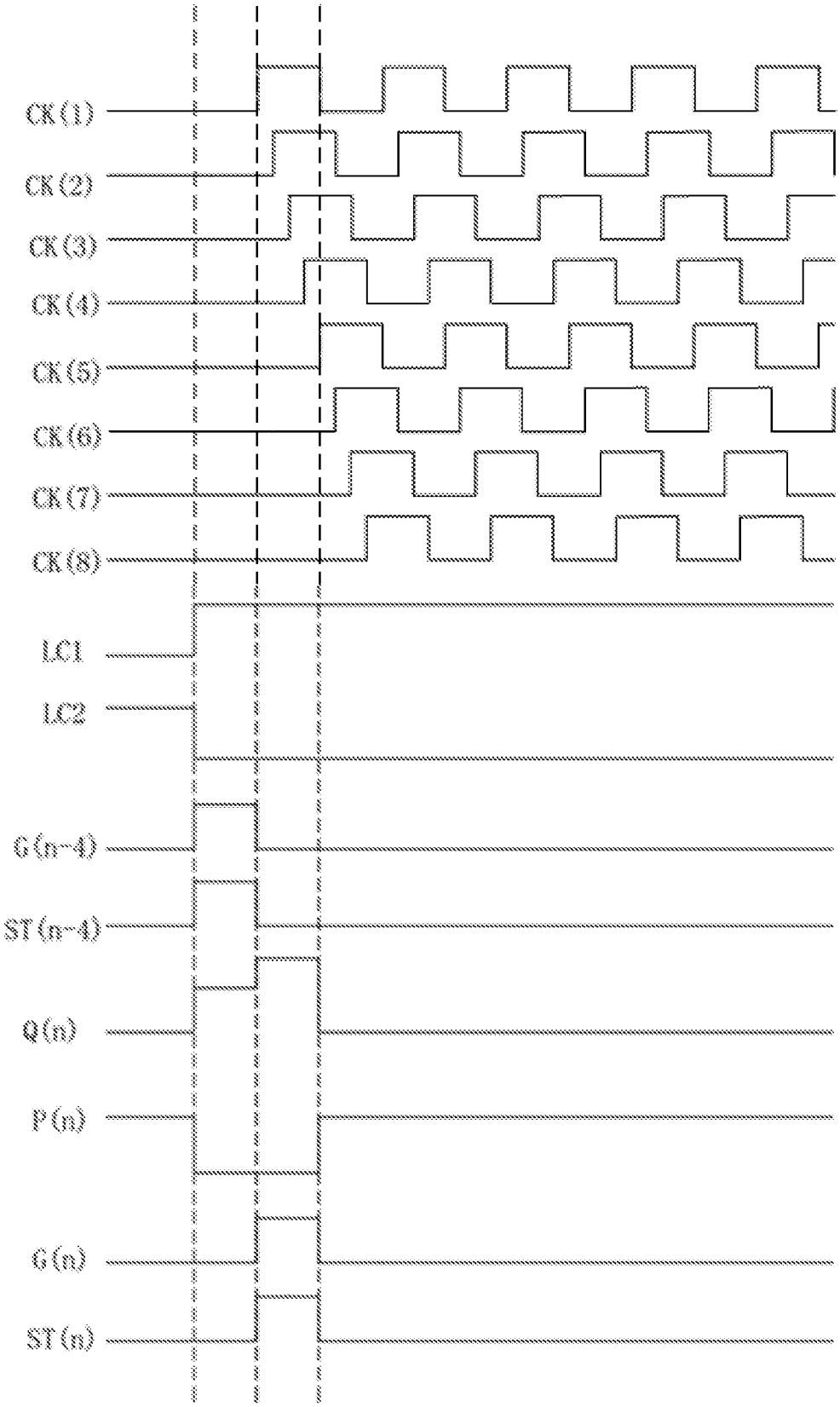
FIG. 2 is a timing diagram of the GOA circuit of the present invention.

In specific, as shown in FIG. 2, the high-frequency clock signal CK received by the nth stage of GOA unit is one of a first high-frequency clock signal CK(1), a second high-frequency clock signal CK(2), a third high-frequency clock signal CK(3), a fourth high-frequency clock signal CK(4), a fifth high-frequency clock signal CK(5), a sixth high-frequency clock signal CK(6), a seventh high-frequency clock signal CK(7) and an eighth high-frequency clock signal CK(8). The phase of the high-frequency clock signal CK received by the nth stage of GOA unit is opposite to the phase of the high-frequency clock signal CK received by the (n+4)th stage of GOA unit.

Further, as shown in FIG. 2, the phases of the first high-frequency clock signal CK(1), the second high-frequency clock signal CK(2), the third high-frequency clock signal CK(3), the fourth high-frequency clock signal CK(4), the fifth high-frequency clock signal CK(5), the sixth high-frequency clock signal CK(6), the seventh high-frequency clock signal CK(7) and the eighth high-frequency clock signal CK(8) are shifted in sequence. The cycles of the first high-frequency clock signal CK(1), the second high-frequency clock signal CK(2), the third high-frequency clock signal CK(3), the fourth high-frequency clock signal CK(4), the fifth high-frequency clock signal CK(5), the sixth high-frequency clock signal CK(6), the seventh high-frequency clock signal CK(7) and the eighth high-frequency clock signal CK(8) are same, and the duty cycles thereof are 0.5. The waveform difference between two adjacent high-frequency clock signals is one-eighth cycle. For example, the difference between the rising edge of the first high-frequency clock signal CK(1) and the rising edge of the second high-frequency clock signal CK(2) is one-eighth cycle.

Preferably, the cycles of the first high-frequency clock signal CK(1), the second high-frequency clock signal CK(2), the third high-frequency clock signal CK(3), the fourth high-frequency clock signal CK(4), the fifth high-frequency clock signal CK(5), the sixth high-frequency clock signal CK(6), the seventh high-frequency clock signal CK(7) and the eighth high-frequency clock signal CK(8) all are 30 ps. The first to eighth stages of GOA units are receiving in sequence the first high-frequency clock signal CK(1), the second high-frequency clock signal CK(2), the third high-frequency clock signal CK(3), the fourth high-frequency clock signal CK(4), the fifth high-frequency clock signal CK(5), the sixth high-frequency clock signal CK(6), the seventh high-frequency clock signal CK(7) and the eighth high-frequency clock signal CK(8). The ninth to sixteenth stages of GOA units are also receiving in sequence the first high-frequency clock signal CK(1), the second high-frequency clock signal CK(2), the third high-frequency clock signal CK(3), the fourth high-frequency clock signal CK(4), the fifth high-frequency clock signal CK(5), the sixth high-frequency clock signal CK(6), the seventh high-frequency clock signal CK(7) and the eighth high-frequency clock signal CK(8), and so on to the last one stage of GOA unit.

Further, as shown in FIG. 2, the first DC low potential Vss1 is larger than the second DC low potential Vss2. The phase of the first low-frequency clock signal LC1 is opposite to the phase of the second low-frequency clock signal LC2.

Preferably, the cycles of the first low-frequency clock signal LC1 and the second low-frequency clock signal LC2 are both the duration of 200 frames.

It should be noted, in the preferred embodiment of the present invention, while the nth stage of GOA unit is receiving the first high-frequency clock signal CK(1) and the (n+4)th stage of GOA unit is receiving the fifth high-frequency clock signal CK(5), the operation of the GOA circuit is as the following periods.

Period 1, pre-charging:

The stage transmitting signal ST(n−4) of the (n−4)th stage of GOA unit is at high voltage level, the first thin film transistor T1 and the second thin film transistor T2 are switched on, and the high voltage level of the stage transmitting signal ST(n−4) of the (n−4)th stage of GOA unit is input to the first node Q(n), to pull up the voltage level of the first node Q(n) to high voltage level. Then, the fifth thin film transistor T5 and the fourth thin film transistor T4 are switched on, and the first high-frequency clock signal CK(1) is outputting with low voltage level.

The nineteenth, twentieth, thirteenth and twelfth thin film transistors T19, T20, T13 and T12 are switched on, the voltage levels of the third and fourth nodes P(n) and K(n) are pulled down to the second DC low potential Vss2. The seventh, eighth, ninth, fourteenth, fifteenth and sixteenth thin film transistors T7, T8, T9, T14, T15 and T16 are switched off, and the voltages between the gates and the sources of the seventh, eighth, ninth, fourteenth, fifteenth and sixteenth thin film transistors T7, T8, T9, T14, T15 and T16 are equal to the value of the second DC low potential Vss2 minus the first DC low potential Vss1. Because the first DC low potential Vss1 is larger than the second DC low potential Vss2, the voltages between the gates and the sources of the seventh, eighth, ninth, fourteenth, fifteenth and sixteenth thin film transistors T7, T8, T9, T14, T15 and T16 are negative values, thereby to ensure these thin film transistors being switched off totally.

The scan signal G(n+4) and the first node Q(n+4) of the (n+4)th stage of GOA unit are both at low voltage level, the third thin film transistor T3 and the sixth thin film transistor T6 are both switched off.

Period 2, outputting scan signal:

The stage transmitting signal ST(n−4) of the (n−4)th stage of GOA unit is at low voltage level, the first thin film transistor T1 and the second thin film transistor T2 are switched off, the first high-frequency clock signal CK(1) is outputting with high voltage level, and the fourth and fifth thin film transistors T4 and T5 are switched on to output individually the high voltage levels of scan signal G(n) and the stage transmitting signal ST(n). The bootstrap capacitor Cb causes the voltage level of the first node Q(n) to be pulled up higher, and at the same time the voltage level of the first node Q(n+4) of the (n+4)th stage of GOA unit is pulled up at high level, the third thin film transistor T3 is switched on, and the high voltage level of the first high-frequency clock signal CK(1) is outputting to the second node W(n), to make the voltages between the gates and the sources of the first thin film transistor T1 and the second thin film transistor T2 be negative values, thereby to ensure these thin film transistors being switched off totally.

Period 3, pulling down the voltage level of the first node:

The scan signal G(n+4) of the (n+4)th stage of GOA unit is changed to high voltage level, the sixth thin film transistor T6 is switched on, the low voltage level of the first high-frequency clock signal CK(5) is outputting to the second node W(n), and the voltage level of the first node Q(n) is pulled down to low voltage level.

Period 4, holding the low voltage level:

The first node Q(n) is at low voltage level, the twelfth, thirteenth, nineteenth and twentieth thin film transistors T12, T13, T19 and T20 are switched off, and the first low-frequency clock signal LC1 and the second low-frequency clock signal LC2 are at high voltage level, to make the third node P(n) and the fourth node K(n) be at high voltage level. The seventh, eighth and ninth thin film transistors T7, T8 and T9 are switched on or the fourteenth, the fifteenth and the sixteenth thin film transistors T14, T15 and T16 are switched on, to pull down the voltage levels of the first node Q(n), the stage transmitting signal ST(n) and the scan signal G(n) to the first DC low potential Vss1, and then to maintain the voltage levels thereof.

It should be noted, for achieving the circuits starting normally, in the first to fourth stages of GOA units of present invention, the first start signal is applied to replace the stage transmitting signal ST(n−4) of the (n−4)th stage of GOA unit, for inputting to the pull-up controlling module 100, to have the circuit operate normally. In the fourth from the last to the last one stages of GOA units, the second start signal is applied to replace the first node Q(n+4) of the (n+4)th stage of GOA unit, for inputting to the pull-up controlling module 100, to control the high-frequency clock signal CK to be input to the second node W(n). Preferably, the pulse cycles of the first start signal and the second start signal are one frame duration and the pulse widths thereof are 30 μs.

Through the simulation test, the GOA circuit can still work normally even the threshold voltage shifting 5V in negative direction, thereby to effectively promote the working stability of the GOA circuits.

According to aforementioned, the present invention provides a GOA circuit, and the nth stage of GOA unit in the GOA circuit uses the high voltage level of the high-frequency clock signal to pull up the voltage level of the second node during the period of outputting the scan signal, to make the voltage level of the second node be larger than the voltage level of the stage transmitting signal of the (n−4)th stage of GOA unit, thereby to keep the pull-up controlling module in off state during the period of outputting the scan signal, for promoting the stability of the GOA circuit and preventing the GOA circuit from malfunction.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. A gate driver on array (GOA) circuit, comprising:

multiple stages of GOA units connected in cascade, wherein each stage of GOA unit comprises a pull-up controlling module, a pull-up module, a transmission module, a pull-down module, a bootstrap module and a pull-down holding module;

wherein, in a nth stage of GOA unit, n is an integer, and the pull-up controlling module is connected electrically to a first node of a (n+4)th stage of GOA unit and receiving a stage transmitting signal from a (n−4)th stage of GOA unit and a high-frequency clock signal, for pulling up a voltage level of the first node according to the stage transmitting signal from the (n−4)th stage of GOA unit, and pulling down a voltage level of a second node by using the high-frequency clock signal under control of the first node of the (n+4)th stage of GOA unit;

wherein the pull-up module is connected electrically to the first node and receiving the high-frequency clock signal, for outputting a scan signal by using the high-frequency clock signal under the control of the first node;

wherein the transmission module is connected electrically to the first node and receiving the high-frequency clock signal, for outputting the stage transmitting signal by using the high-frequency clock signal under the control of the first node;

wherein the pull-down module is connected electrically to the second node and receiving the scan signal of the (n+4)th stage of GOA unit, for pulling down the voltage level of the first node by using the voltage level of the second node, under control of the scan signal of the (n+4)th stage of GOA unit or a second start signal;

wherein the bootstrap module is connected electrically to the first node and the scan signal, for pulling up and then holding the voltage level of the first node, during a period of outputting the scan signal; and wherein the pull-down holding module is connected electrically to the first node, a third node, a fourth node, a first DC low potential and a second DC low potential, and receiving a first low-frequency clock signal, a second low-frequency clock signal, the scan signal and the stage transmitting signal, for pulling down voltage levels of the third node and the fourth node to the second DC low potential when the voltage level of the first node is pulled up, and for pulling up the voltage levels of the third node and the fourth node by using the first low-frequency clock signal and the second low-frequency clock signal alternatively, after the voltage level of the first node is pulled down, to maintain the voltage levels of the first node, the stage transmitting signal and the scan signal at the first DC low potential.

2. The GOA circuit according to claim 1, wherein the pull-down holding module comprises:

a first pull-down holding circuit and a second pull-down holding circuit;

wherein the first pull-down holding circuit is connected electrically to the first node, the third node, the first DC low potential and the second DC low potential, and is receiving the first low-frequency clock signal, the scan signal and the stage transmitting signal, for pulling down the voltage level of the third node to the second DC low potential when the voltage level of the first node is pulled up, and for pulling up the voltage level of the third node periodically by using the first low-frequency clock signal, after the voltage level of the first node is pulled down, to maintain the voltage levels of the first node, the stage transmitting signal and the scan signal at the first DC low potential; and wherein the second pull-down holding circuit is connected electrically to the first node, the fourth node, the first DC low potential and the second DC low potential, and is receiving the second low-frequency clock signal, the scan signal and the stage transmitting signal, for pulling down the voltage level of the fourth node to the second DC low potential when the voltage level of the first node is pulled up, and for pulling up the voltage level of the fourth node periodically by using the second low-frequency clock signal, after the voltage level of the first node is pulled down, to maintain the voltage levels of the first node, the stage transmitting signal and the scan signal at the first DC low potential.

3. The GOA circuit according to claim 2, wherein the first pull-down holding circuit comprises a seventh thin film transistor, an eighth thin film transistor, a ninth thin film transistor, a tenth thin film transistor, an eleventh thin film transistor, a twelfth thin film transistor and a thirteen thin film transistor;

wherein the seventh thin film transistor includes a gate connected electrically to the third node, a drain receiving the scan signal, and a source receiving the first DC low potential;

wherein the eighth thin film transistor includes a gate connected electrically to the third node, a drain receiving the stage transmitting signal, and a source receiving the first DC low potential;

wherein the ninth thin film transistor includes a gate connected electrically to the third node, a drain connected electrically to the first node, and a source receiving the first DC low potential;

wherein the tenth thin film transistor includes a gate and a source both receiving a first low-frequency clock signal, and a drain connected electrically to a gate of the eleventh thin film transistor;

wherein the eleventh thin film transistor includes a source receiving the first low-frequency clock signal, and a drain connected electrically to the third node;

wherein the twelfth thin film transistor includes a gate connected electrically to the first node, a source connected electrically to the gate of the eleventh thin film transistor, and a drain receiving the second DC low potential;

wherein the thirteenth thin film transistor includes a gate connected electrically to the first node, a source connected electrically to the third node, and a drain receiving the second DC low potential;

wherein the second pull-down holding circuit comprises a fourteenth thin film transistor, a fifteenth thin film transistor, a sixteenth thin film transistor, a seventeenth thin film transistor, an eighteenth thin film transistor, a nineteenth thin film transistor and a twentieth thin film transistor;

wherein the fourteenth thin film transistor includes a gate connected electrically to the fourth node, a drain connected electrically to the first node, and a source receiving the first DC low potential;

wherein the fifteenth thin film transistor includes a gate connected electrically to the fourth node, a drain receiving the stage transmitting signal, and a source receiving the first DC low potential;

wherein the sixteenth thin film transistor includes a gate connected electrically to the fourth node, a drain receiving the scan signal, and a source receiving the first DC low potential;

wherein the seventeenth thin film transistor includes a gate and a source both receiving a second low-frequency clock signal, and a drain connected electrically to a gate of the eighteenth thin film transistor;

wherein the eighteenth thin film transistor includes a source receiving the second low-frequency clock signal and a drain connected electrically to the fourth node;

wherein the nineteenth thin film transistor includes a gate connected electrically to the first node, a source connected electrically to the gate of the eighteenth thin film transistor, and a drain receiving the second DC low potential; and wherein the twentieth thin film transistor includes a gate connected electrically to the first node, a source connected electrically to the fourth node, a drain receiving the second DC low potential.

4. The GOA circuit according to claim 1, wherein the pull-up controlling module comprises:

a first thin film transistor, a second thin film transistor and a third thin film transistor;

wherein the first thin film transistor includes a gate and a source both receiving the stage transmitting signal of the (n−4)th stage of GOA unit, and a drain connected electrically to the second node;

wherein the second thin film transistor includes a gate receiving the stage transmitting signal of the (n−4)th stage of GOA unit, a source connected electrically to the second node, and a drain connected electrically to the first node; and wherein the third thin film transistor includes a gate connected electrically to the first node of the (n+4)th stage of GOA unit, a source connected electrically to the second node, and a drain receiving the high-frequency clock signal.

5. The GOA circuit according to claim 1, wherein the pull-up module comprises: a fourth thin film transistor, wherein the fourth thin film transistor includes a gate connected electrically to the first node, a source receiving the high-frequency clock signal, and a drain outputting the scan signal.

6. The GOA circuit according to claim 1, wherein the transmission module comprises:

a fifth thin film transistor, wherein the fifth thin film transistor includes a gate connected electrically to the first node, a source receiving the high-frequency clock signal, and a drain outputting the stage transmitting signal.

7. The GOA circuit according to claim 1, wherein the pull-down module comprises:

a sixth thin film transistor, wherein the sixth thin film transistor includes a gate receiving the scan signal of the (n+4)th stage of GOA unit, a source connected to the second node, and a drain connected to the first node.

8. The GOA circuit according to claim 1, wherein the bootstrap module comprises:

a bootstrap capacitor, wherein the bootstrap capacitor includes a first terminal connected to the first node and a second terminal receiving the scan signal.

9. The GOA circuit according to claim 1, wherein the high-frequency clock signal received by the nth stage of GOA unit is one of a first high-frequency clock signal, a second high-frequency clock signal, a third high-frequency clock signal, a fourth high-frequency clock signal, a fifth high-frequency clock signal, a sixth high-frequency clock signal, a seventh high-frequency clock signal and an eighth high-frequency clock signal, and a phase of the high-frequency clock signal received by the nth stage of GOA unit is opposite to a phase of the high-frequency clock signal received by the (n+4)th stage of GOA unit.

10. The GOA circuit according to claim 1, wherein the first DC low potential is larger than the second DC low potential; a phase of the first low-frequency clock signal is opposite to a phase of the second low-frequency clock signal.

11. A gate driver on array (GOA) circuit, comprises:

multiple stages of GOA units connected in cascade, wherein each stage of GOA unit comprises a pull-up controlling module, a pull-up module, a transmission module, a pull-down module, a bootstrap module and a pull-down holding module;

wherein, in a nth stage of GOA unit, n is an integer, and the pull-up controlling module is connected electrically to a first node of a (n+4)th stage of GOA unit and receiving a stage transmitting signal from a (n−4)th stage of GOA unit and a high-frequency clock signal, for pulling up a voltage level of the first node according to the stage transmitting signal of a (n−4)th stage of GOA unit, and pulling down a voltage level of a second node by using the high-frequency clock signal under control of the first node of the (n+4)th stage of GOA unit;

wherein the pull-up module is connected electrically to the first node and receiving the high-frequency clock signal, for outputting a scan signal by using the high-frequency clock signal under the control of the first node;

wherein the transmission module is connected electrically to the first node and receiving the high-frequency clock signal, for outputting the stage transmitting signal by using the high-frequency clock signal under the control of the first node;

wherein the pull-down module is connected electrically to the second node and receiving the scan signal of the (n+4)th stage of GOA unit, for pulling down the voltage level of the first node by using the voltage level of the second node, under control of the scan signal of the (n+4)th stage of GOA unit or a second start signal;

wherein the bootstrap module is connected electrically to the first node and the scan signal, for pulling up and then holding the voltage level of the first node, during a period of outputting the scan signal; and wherein the pull-down holding module is connected electrically to the first node, a third node, a fourth node, a first DC low potential and a second DC low potential, and receiving a first low-frequency clock signal, a second low-frequency clock signal, the scan signal and the stage transmitting signal, for pulling down voltage levels of the third node and the fourth node to the second DC low potential when the voltage level of the first node is pulled up, and for pulling up the voltage levels of the third node and the fourth node by using the first low-frequency clock signal and the second low-frequency clock signal alternatively, after the voltage level of the first node is pulled down, to maintain the voltage levels of the first node, the stage transmitting signal and the scan signal at the first DC low potential;

wherein, the pull-up controlling module comprises: a first thin film transistor, a second thin film transistor and a third thin film transistor;

wherein the first thin film transistor includes a gate and a source both receiving the stage transmitting signal of the (n−4)th stage of GOA unit, and a drain connected electrically to the second node;

wherein the second thin film transistor includes a gate receiving the stage transmitting signal of the (n−4)th stage of GOA unit, a source connected electrically to the second node, and a drain connected electrically to the first node;

wherein the third thin film transistor includes a gate connected electrically to the first node of the (n+4)th stage of GOA unit, a source connected electrically to the second node, and a drain receiving the high-frequency clock signal;

wherein the pull-up module comprises: a fourth thin film transistor, wherein the fourth thin film transistor includes a gate connected electrically to the first node, a source receiving the high-frequency clock signal, and a drain outputting the scan signal;

wherein the transmission module comprises: a fifth thin film transistor, wherein the fifth thin film transistor includes a gate connected electrically to the first node, a source receiving the high-frequency clock signal, and a drain outputting the stage transmitting signal;

wherein the pull-down module comprises:

a sixth thin film transistor, wherein the sixth thin film transistor includes a gate receiving the scan signal of the (n+4)th stage of GOA unit, a source connected to the second node, and a drain connected to the first node; and wherein the bootstrap module comprises:

a bootstrap capacitor, wherein the bootstrap capacitor includes a first terminal connected to the first node and a second terminal receiving the scan signal.

12. The GOA circuit according to claim 11, wherein the pull-down holding module comprises:

a first pull-down holding circuit and a second pull-down holding circuit;

wherein, the first pull-down holding circuit is connected electrically to the first node, the third node, the first DC low potential and the second DC low potential, and is receiving the first low-frequency clock signal, the scan signal and the stage transmitting signal, for pulling down the voltage level of the third node to the second DC low potential when the voltage level of the first node is pulled up, and for pulling up the voltage level of the third node periodically by using the first low-frequency clock signal, after the voltage level of the first node is pulled down, to maintain the voltage levels of the first node, the stage transmitting signal and the scan signal at the first DC low potential; and wherein, the second pull-down holding circuit is connected electrically to the first node, the fourth node, the first DC low potential and the second DC low potential, and is receiving the second low-frequency clock signal, the scan signal and the stage transmitting signal, for pulling down the voltage level of the fourth node to the second DC low potential when the voltage level of the first node is pulled up, and for pulling up the voltage level of the fourth node periodically by using the second low-frequency clock signal, after the voltage level of the first node is pulled down, to maintain the voltage levels of the first node, the stage transmitting signal and the scan signal at the first DC low potential.

13. The GOA circuit according to claim 12, wherein the first pull-down holding circuit comprises a seventh thin film transistor, an eighth thin film transistor, a ninth thin film transistor, a tenth thin film transistor, a eleventh thin film transistor, a twelfth thin film transistor and a thirteen thin film transistor;

wherein the seventh thin film transistor includes a gate connected electrically to the third node, a drain receiving the scan signal, and a source receiving the first DC low potential;

wherein the eighth thin film transistor includes a gate connected electrically to the third node, a drain receiving the stage transmitting signal, and a source receiving the first DC low potential;

wherein the ninth thin film transistor includes a gate connected electrically to the third node, a drain connected electrically to the first node, and a source receiving the first DC low potential;

wherein the tenth thin film transistor includes a gate and a source both receiving a first low-frequency clock signal, and a drain connected electrically to a gate of the eleventh thin film transistor;

wherein the eleventh thin film transistor includes a source receiving the first low-frequency clock signal, and a drain connected electrically to the third node;

wherein the twelfth thin film transistor includes a gate connected electrically to the first node, a source connected electrically to the gate of the eleventh thin film transistor, and a drain receiving the second DC low potential;

wherein the thirteenth thin film transistor includes a gate connected electrically to the first node, a source connected electrically to the third node, and a drain receiving the second DC low potential;

wherein the second pull-down holding circuit comprises a fourteenth thin film transistor, a fifteenth thin film transistor, a sixteenth thin film transistor, a seventeenth thin film transistor, an eighteenth thin film transistor, a nineteenth thin film transistor and a twentieth thin film transistor;

wherein the fourteenth thin film transistor includes a gate connected electrically to the fourth node, a drain connected electrically to the first node, and a source receiving the first DC low potential;

wherein the fifteenth thin film transistor includes a gate connected electrically to the fourth node, a drain receiving the stage transmitting signal, and a source receiving the first DC low potential;

wherein the sixteenth thin film transistor includes a gate connected electrically to the fourth node, a drain receiving the scan signal, and a source receiving the first DC low potential;

wherein the seventeenth thin film transistor includes a gate and a source both receiving a second low-frequency clock signal, and a drain connected electrically to a gate of the eighteenth thin film transistor;

wherein the eighteenth thin film transistor includes a source receiving the second low-frequency clock signal and a drain connected electrically to the fourth node;

wherein the nineteenth thin film transistor includes a gate connected electrically to the first node, a source connected electrically to the gate of the eighteenth thin film transistor, and a drain receiving the second DC low potential; and wherein the twentieth thin film transistor includes a gate connected electrically to the first node, a source connected electrically to the fourth node, a drain receiving the second DC low potential.

14. The GOA circuit according to claim 11, wherein the high-frequency clock signal received by the nth stage of GOA unit is one of a first high-frequency clock signal, a second high-frequency clock signal, a third high-frequency clock signal, a fourth high-frequency clock signal, a fifth high-frequency clock signal, a sixth high-frequency clock signal, a seventh high-frequency clock signal and an eighth high-frequency clock signal, and a phase of the high-frequency clock signal received by the nth stage of GOA unit is opposite to a phase of the high-frequency clock signal received by the (n+4)th stage of GOA unit.

15. The GOA circuit according to claim 11, wherein the first DC low potential is larger than the second DC low potential; a phase of the first low-frequency clock signal is opposite to a phase of the second low-frequency clock signal.

* * * * *